US008653399B2

(12) United States Patent
Seid et al.

(10) Patent No.: US 8,653,399 B2
(45) Date of Patent: Feb. 18, 2014

(54) STEEL SHEET HEAT TREATMENT/STAMP SYSTEM AND METHOD

(75) Inventors: Alan Seid, Raymond, OH (US); Masayuki Narita, Dublin, OH (US)

(73) Assignee: Honda Motor Co., Ltd, Tokyo (JP)

( * ) Notice: Subject to any disclaimer, the term of this patent is extended or adjusted under 35 U.S.C. 154(b) by 686 days.

(21) Appl. No.: 12/021,543

(22) Filed: Jan. 29, 2008

(65) Prior Publication Data

US 2009/0188907 A1 Jul. 30, 2009

(51) Int. Cl.
*H05B 1/00* (2006.01)

(52) U.S. Cl.
USPC ..... 219/50; 219/149; 219/161; 219/162

(58) Field of Classification Search
USPC ..... 219/50, 149, 156, 158, 161, 162, 494; 72/47, 342.92, 342.94, 342.96, 350, 72/364, 379.2
See application file for complete search history.

(56) References Cited

U.S. PATENT DOCUMENTS

| | | | | |
|---|---|---|---|---|
| 4,404,047 | A | 9/1983 | Wilks | |
| 4,728,769 | A | 3/1988 | Nishiwaki | |
| 5,515,705 | A | 5/1996 | Weldon et al. | |
| 6,463,779 | B1 * | 10/2002 | Terziakin | 72/342.96 |
| 6,564,604 | B2 | 5/2003 | Kefferstein et al. | |
| 6,742,374 | B2 | 6/2004 | Ozawa | |
| 2005/0252262 | A1 | 11/2005 | Imai et al. | |
| 2006/0060570 | A1 * | 3/2006 | Machrowicz | 219/50 |
| 2006/0121305 | A1 | 6/2006 | Yoshikawa et al. | |
| 2007/0215598 | A1 * | 9/2007 | Pilavdzic | 219/490 |

FOREIGN PATENT DOCUMENTS

| | | | |
|---|---|---|---|
| JP | S63-166926 | | 7/1988 |
| JP | H05-125433 | | 5/1993 |
| JP | 8157951 | A1 | 6/1996 |
| JP | 9071822 | A1 | 3/1997 |
| JP | 2002194518 | A | 7/2002 |
| JP | 2002241835 | A1 | 8/2002 |
| JP | 2004-130376 | A1 | 4/2004 |
| JP | 2007136533 | A1 | 6/2007 |
| WO | 2007/109546 | A2 | 9/2007 |

OTHER PUBLICATIONS

International Search Report, dated Sep. 11, 2009, PCT/US2009/032432.
Written Opinion of the International Searching Authority, dated Sep. 11, 2009, PCT/US2009/032432.

* cited by examiner

*Primary Examiner* — Brian Jennison
(74) *Attorney, Agent, or Firm* — Mark E. Duell; Emerson Thomson Bennett, LLC

(57) ABSTRACT

An apparatus and related method are provided for a manufacturing process including heating of a processed part. A resistance heating assembly applies an electrical current to a work part comprising a sheet of high-tensile steel having a heat-resistant plating to improve formability. A heating control system regulates the electrical current to the work part in order to control the temperature of the work part. A temperature detector detects a temperature of the work part and generates feedback to the heating control system in order to regulate the electrical current. An electrical resistance detector measures an electrical resistance within the work part and generates feedback to the heating control system in order to regulate the electrical current.

17 Claims, 2 Drawing Sheets

STEEL SHEET HEAT TREATMENT/STAMP SYSTEM AND METHOD

I. BACKGROUND OF THE INVENTION

A. Field of Invention

This invention generally relates to stamping and heating operations for manufacturing metal components. The invention has particular applicability to forming a stamped metal part having reduced weight and increased strength.

B. Description of the Related Art

The present invention provides a method and apparatus for manufacturing a stamped metal part that overcomes the problems associated with previous methods and apparatuses which are heated through convection heating in large scale heating furnaces that consume much energy and have a large impact on the environment.

II. SUMMARY OF THE INVENTION

Some embodiments of the present invention relate to an apparatus for heating a processed part in a manufacturing process. A resistance heating assembly applies an electrical current to a work part including a sheet of high-tensile steel having a heat-resistant plating to improve formability. A heating control system regulates the electrical current to the work part in order to control the temperature of the work part. A temperature detector detects a temperature of the work part and generates feedback to the heating control system in order to regulate the electrical current. An electrical resistance detector measures an electrical resistance within the work part and generates feedback to the beating control system in order to regulate the electrical current.

Other embodiments of the invention relate to an apparatus for heating a processed part in a manufacturing process. A resistance heating assembly is provided that includes first and second end clamps, secured to opposite ends of a work part, for supplying the electrical current to the work part for resistance heating. A temperature detector is also provided that detects a temperature of the work part and generates temperature feedback in order to regulate the electrical current. An electrical resistance detector is additionally provided that measures an electrical resistance within the work part and generates electrical resistance feedback in order to regulate the electrical current. A cooling mechanism is further provided for engaging at least one of the first and second clamps to reduce temperature increases in the respective clamp that would cause uneven heating in the work part.

Still other embodiments of the invention relate to a method of heating a processed part during a manufacturing process. Electrical current is supplied to opposite ends of a work part for resistance heating. A temperature of the work part is detected and temperature feedback is generated in order to regulate the electrical current. An electrical resistance is measured within the work part and electrical resistance feedback is generated in order to regulate the electrical current.

Other benefits and advantages will become apparent to those skilled in the art to which it pertains upon reading and understanding the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

The present invention generally relates to systems and methods for heating and stamping a metal part. In particular, the present invention relates to systems and methods for heating a metal part as a part of a stamping operation, where heating is regulated by simultaneously measuring both the temperature and the electrical resistance in the metal part. The metal part is a sheet having a heat-resistant plating that improves formability and allows rapid heating without melting or dissipation of the plating layer.

The present invention overcomes problems associated with efficiency in material and energy consumption in manufacturing processes. Specifically, the present invention has particular applicability to the automotive industry by producing a high-strength, lightweight manufactured part that results in a vehicle with improved fuel economy with less energy consumed during manufacture, and also having improved compliance with regulations for crash safety.

The present invention utilizes an electrical resistance heating process of a steel sheet rather than using a conventional large scale furnace that requires a large space and consumes much energy, thus having a considerable environmental impact. Simultaneously measuring both temperature and electrical resistance in the heated part allows comparison of a measured temperature value with a theoretical value, and thus precise control of the heating of the work part can be obtained. The heating step is part of a manufacturing process including a stamping process, performed simultaneously with the heating process, which is followed by quick cooling in a quenching process, in order to increase the metallurgical strength of the part.

Figure 1:
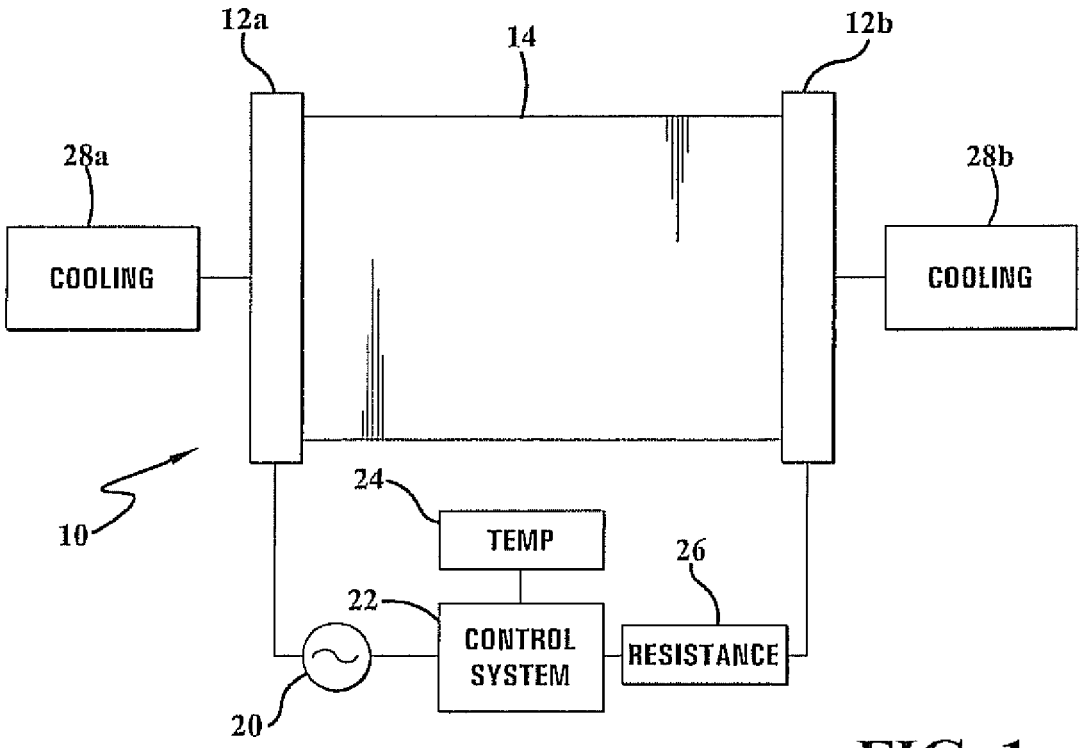
FIG. 1 is a plan schematic view depicting a resistance heating system in accordance with an embodiment of the present invention.

Reference is now made to the drawings wherein the showings are for purposes of illustrating embodiments of the invention only and not for purposes of limiting the same, and where it is to be understood that like reference numerals to refer to like components. FIG. 1 illustrates an apparatus 10 for a manufacturing process that includes heating a processed part. A resistance heating assembly 12*a*, 12*b* applies an electrical current to a work part 14. The work part 14 is a sheet of high-tensile steel having a heat-resistant plating to improve formability. In the preferred embodiment, the resistance heating assembly 12*a*, 12*b* preferably includes a first end clamp 12*a* and a second end clamp 12*b*. These end clamps 12*a*, 12*b* are secured to opposite ends of the work part 14 and supply the electrical current to the work part 14 for resistance heating.

In using the techniques of resistance heating (as are well known in the art) toe work part 14 is in an electrical circuit with an electrical generator 20. An electrical current is passed between the end clamps 12*a*, 12*b* and thereby through the work part 14. In this way, electrical energy is imparted to the work part 14 in the form of heat. Heat energy is thereby applied directly to the work part 14 in a precise, efficient manner, in contrast to typical convectional heating in which the entire volume of a furnace is heated to heat a work part.

A heating control system 22 is provided that regulates the electrical current to the work part 14 in order to control the temperature of the work part. A temperature detector 24 is provided that detects a temperature of the work part 14 and generates feedback to the heating control system 22 in order to regulate the electrical current. An electrical resistance detector 26 measures an electrical resistance within the work part 14 and generates feedback to the heating control system 22 in order to regulate the electrical current.

The temperature detector 24 employs thermal detection techniques to measure a heating condition in the work part 14 and to generate feedback to the heating control system 22. The temperature detector 24 can be a radiative sensor, displaced from the surface of the work part 14, to measure heat radiation coming from the work part 14. The heating control system 22 includes a processor component for correlating the measured heat radiation with the temperature of the work part 14. Alternatively, the temperature detector 24 can be a sensor in direct contact with the work part 14. The temperature detector 24 can be a single sensor adapted to measure temperature in one selected area, or it can be either a linear or a surface sensor array that respectively measures at least a portion of the length or the surface of the work part 14, in order to collect a number of data points from the work part 14 indicative of temperature. In any event, the temperature detector 24 monitors temperature in order to provide quick and even heating to the work part 14.

Additionally, the heating control system 22 can apply a predetermined electrical current to the work part 14 for a predetermined period of time, so as to impart a calculated temperature to the work part 14, where the resistance and heat capacity of the work part 14 is also predetermined. The calculated temperature can be correlated with the measured temperature to compare the calculated and measured data, and thereby provide a precise control of the temperature of the work part 14. In this way, a desired temperature can be rapidly achieved by applying a large current to the work part 14 for a short interval.

In addition to temperature detection, the electrical resistance detector 26 measures the electrical resistance within die work part and generates feedback to the heating control system 22 in order to regulate the electrical current. As shown particularly in FIG. 1, the electrical resistance detector 26 can be a component in series with the work part 14 in the circuit that measures the current drawn by the work part 14. In addition or alternatively, the electrical resistance detector 26 can be configured to each end clamp 12*a*, 12*b* to measure the voltage drop across the work part 14.

It is a property of conductors that electrical resistance varies as a function of temperature. Therefore, a measurement of the electrical resistance of the work part 14 directly indicates the temperature of the metal. The heating control system 22 is programmed with known resistance values for a steel sheet of the work part, having the specified dimensions, and also includes an algorithm that models the variation of resistance with respect to temperature, so as to arrive at a theoretical value for temperature as a function of electrical resistance.

The heating control system 22 receives the feedback from the electrical resistance detector 26 and processes that information as additional data to mace a separate, independent calculation of the temperature of the work part 14. The heating control system 22 compares the independent temperature data from the temperature detector 24 and the electrical resistance detector 26 to arrive at a precise value of the temperature of the work part 14. Simultaneous measurement of both temperature and electrical resistance in the work part 14 allows comparison of a measured temperature value with a theoretical value, and thus provides precise control of the heating of the work part 14.

In order to preclude localized heating in the vicinity of the first and second end clamps 12*a*, 12*b*, one or both of the first and second clamps 12*a*, 12*b* include a cooling mechanism 28*a*, 28*b* to reduce temperature increases in the respective clamp. These localized temperature increases would otherwise cause uneven heating in the work part 14 and could affect its formability or the metallurgical properties of the finished product. This cooling mechanism 28*a*, 28*b* can be a fluid jacket that encases the end clamps 12*a*, 12*b* and supplies cooling fluid thereto. The cooling fluid can come from any fluid source, such as the quenching bath (as will be explained herein below).

Figure 2:
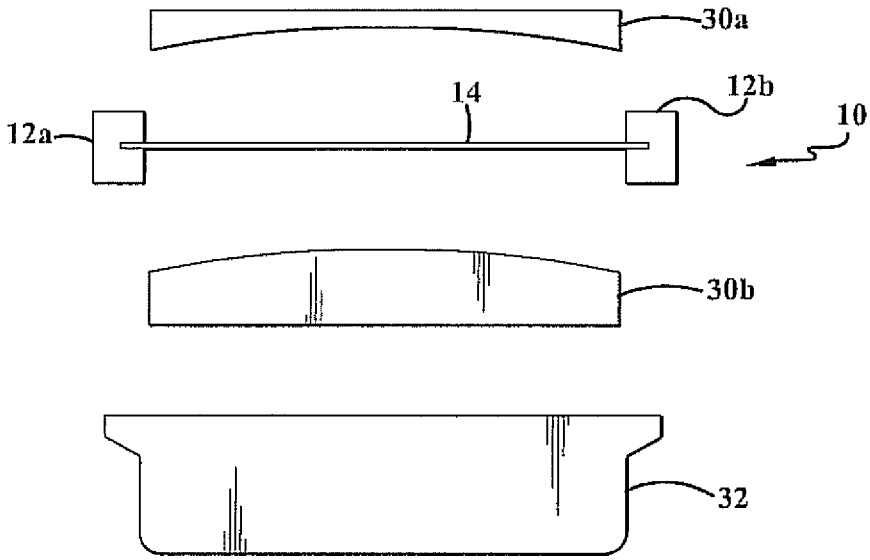
FIG. 2 is a side-sectional view illustrating a heating and stamping system in accordance with an embodiment of the present invention.

As shown in FIG. 2, the manufacturing apparatus 10 is preferably for simultaneously heating and stamping a processed part. As the resistance heating assembly 12 applies an electrical current to a work part 14, a stamping assembly 30*a*, 30*b* stamps the plated sheet 14 simultaneously during resistance heating to form a stamped work part. A quenching bath 32 quickly cools the work part 14 to metallurgically increase the mechanical strength of the work part 14.

As shown in FIG. 1, the stamping assembly includes a first die 30*a* and a second die 30*b* that reciprocally come together over the work part 14 to apply a large force. The first and second dies 30*a*, 30*b* have respective mating surfaces in the shape of the final product. The dies 30*a*, 30*b* are preferably driven together by a hydraulic assembly (not shown) as is commonly known in the art. As contemplated with the present invention, the work part 14 is inserted into the end clamps 12*a*, 12*b* and the electricity is applied to the work part 14 to rapidly raise its temperature to the desired level. Simultaneously, the stamping dies 30*a*, 30*b* come together over the work part 14 to form the final stamped product.

The controlled application of heat and the temperature monitoring of the work part allows a predetermined high temperature to be rapidly applied by the heating assembly 12. In this way, the steel sheet of the work part reaches the temperature of the high-strength martensitic phase of the steel sheet. This martensitic metallurgical state of the work part 14 achieved at the higher temperature is preserved and maintained by rapidly quenching the work part 14.

Figure 3:
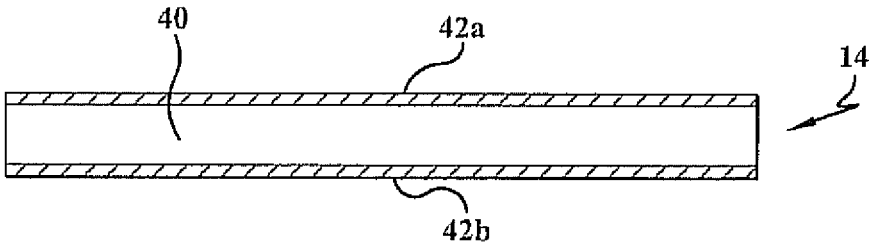
FIG. 3 is a side-sectional view showing a steel sheet covered with a heat-resistant plating in accordance with an embodiment of the present invention.

As shown especially in FIG. 3, the work part 14 is formed of a steel sheet 40 that is plated on the top and bottom surfaces with heat-resistant plating layers 42*a*, 42*b*. The heat-resistant plating layers 42*a*, 42*b* have a higher fusing point temperature that allows rapid heating of the work part to the martensitic phase, since the common aluminum plating can melt or dissipate at these temperatures.

The heat-resistant plating layers 42*a*, 42*b* can include an oxidized aluminum layer that has a higher melting point than aluminum metal, and thereby resists melting or dissipation at the operating temperatures suitable for steel hardening. The oxidized layer can be formed by plating aluminum to the steel sheet 40 and then oxidizing the aluminum layers 42*a*, 42*b* through a chemical process. The oxidized aluminum layers 42*a*, 42*b* maintain the formability of the sheet at the desired temperatures, thereby allowing the stamping operation to produce a metal part having the desired metallurgical properties.

Melting and dissipation of the plated layers can also be controlled by a process of slowly heating an aluminum plated work part 14 until an alloy layer forms along the boundary of the steel plate substrate. This alloy has a higher fusing point than non-alloy aluminum. However, considerable heating time is required to reach this alloy phase, which thus adversely affects productivity and efficiency. The heat-resistant plating layers 42*a*, 42*b* can be formed of an aluminum alloy having a higher fusing point than non-alloy aluminum, so as to resist melting and dissipation at operating temperatures suitable for steel hardening. The aluminum alloy can be an aluminum/steel alloy, a zinc/steel alloy or an alloy of aluminum and zinc, with or without steel in the alloy matrix. The alloy layers 42*a*, 42*b* maintain the formability of the sheet at the desired temperatures, so as to allow a stamping operation that produces a metal part having the suitable metallurgical properties.

Figure 4:
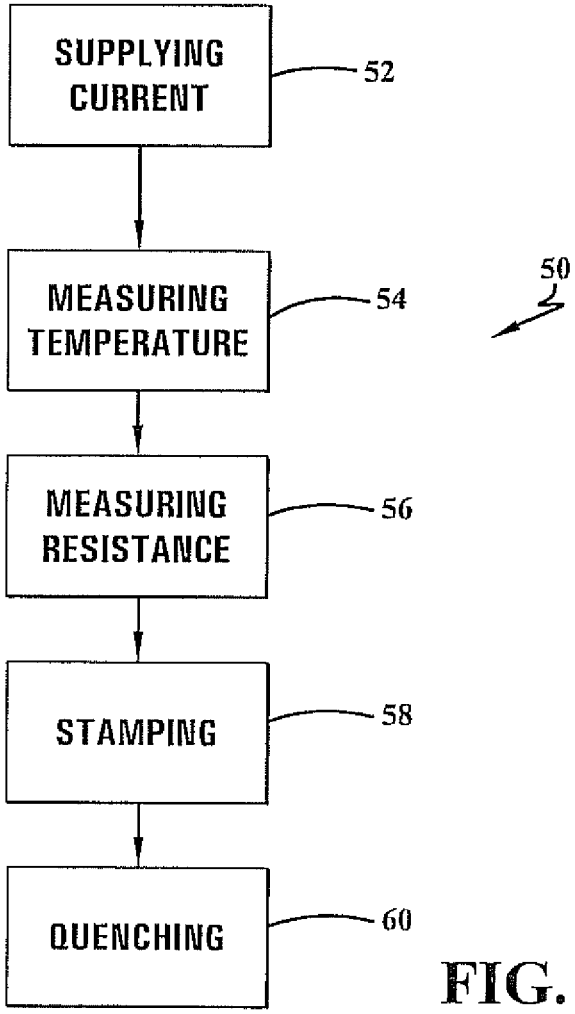
FIG. 4 is a flow chart depicting steps in a method of manufacturing in accordance with all embodiment of the present invention.

FIG. 4 is a flow chart depicting a method 50 of heating a processed part in a manufacturing process in accordance with the present invention. A step 52 is performed of supplying electrical current to opposite ends of a work part to produce resistance heating. In this way, the electrical energy is converted into heat within the steel work part.

A step 54 is performed of measuring a temperature of the work part and generating temperature feedback in order to regulate the electrical current. At the same time, a step 56 is performed of measuring an electrical resistance within the work part and generating electrical resistance feedback in order to regulate the electrical current. The steps 52, 54 of measuring temperature and electrical resistance include controlling heating in response to both the temperature feedback and the electrical resistance feedback in order to control the temperature of the work part.

Uneven heating may occur since the temperature of the work part may be higher at the ends where the current is applied. Therefore, an intermediate step is performed of reducing localized temperature increases at the opposite ends that would cause uneven heating in the work part. This is can be done by applying a cooling material such as a fluid to the apparatus at each end of the work part.

The method 50 also can include an additional step 58 of stamping the work part simultaneously during resistance heating to form a stamped work part. First and second stamping dies are brought together across the work part while it is being heated, so that the work part reaches its desired temperature just as the dies are coming together, thus saving time and improving energy efficiency. Another step 60 of quenching the stamped work part through quick cooling is performed to thereby increase its metallurgical strength. In this way, a finished part is formed that is lightweight and strong, and is manufactured quickly and with a high level of energy efficiency.

The step 54 of detecting the temperature can be performed by measuring heat radiation coming from the work part. Alternatively, temperature can be measured from direct contact with the work part. The thermal state of the work part can be measured in one selected area, along either the length or the surface of the work part, so as to collect a number of data points indicative of temperature.

The step 56 of measuring resistance over the work part can be performed by an in-series measurement of the current drawn by the work part. Alternatively: the electrical resistance can be found by measuring the voltage drop across the work part. Since the electrical resistance of a conductor varies as a function of temperature, a measurement of the electrical resistance of the work part directly indicates the temperature of the metal. The step 56 of measuring resistance also includes a comparison of the resistance values for steel sheet of the work part, and also includes processing an algorithm that models the variation of resistance with respect to temperature, so as to arrive at a theoretical value for temperature as a function of electrical resistance.

The process 50 also includes the step of stamping 58, wherein the reciprocal elements of the die 30*a*, 30*b* come together to form a stamped product from work part 14. Finally, process 50 includes the step of quenching 60, wherein the stamped product is rapidly cooled, thereby locking in the martensitic phase structure.

The embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

We claim:

1. An apparatus for a manufacturing process comprising:

a resistance heating assembly that applies an electrical current to a work part comprising a sheet of high-tensile steel having a heat-resistant plating to improve formability;

a heating control system that regulates the electrical current to the work part in order to control the temperature of the work part;

a temperature detector that detects a first temperature of the work part and generates feedback to the heating control system in order to regulate the electrical current;

an electrical resistance detector that measures an electrical resistance within the work part to calculate a second temperature and generates feedback to the heating control system in order to regulate the electrical current; and, wherein the heating control system compares the first temperature with the second temperature to determine the precise temperature of the work part;

wherein the resistance heating assembly comprises first and second end clamps, secured to opposite ends of the work part, for supplying the electrical current to the work part for resistance heating; and wherein at least one of the first and second end clamps comprises a cooling mechanism to reduce temperature increases in the respective clamp that would cause uneven heating in the work part.

2. The apparatus of claim 1, further comprising:

a stamping assembly that stamps the work part simultaneously during resistance heating to form a stamped work part; and a quenching bath that quenches the work part through quick cooling to increase strength.

3. The apparatus of claim 1, wherein the cooling mechanism comprises a fluid jacket that encases the respective end clamp and supplies cooling fluid to the respective end clamp.

4. The apparatus of claim 1, wherein the heat-resistant plating on the work part comprises a high fusing point plating material.

5. The apparatus of claim 1, wherein the temperature detector comprises a thermal sensor in contact with the work part, and the electrical resistance detector comprises at least one from the group consisting of: a component in series with the work part that measures the current drawn by the work part, and a component configured to each end clamp that measures the voltage drop across the work part.

6. The apparatus of claim 1, wherein the temperature detector comprises a radiative sensor for measuring heat radiation radiating from the work part, and the electrical resistance detector comprises at least one from the group consisting of: a component in series with the work part that measures the current drawn by the work part, and a component configured to each end clamp that measures the voltage drop across the work part.

7. An apparatus for a manufacturing process comprising:

a resistance heating assembly that comprises first and second end clamps, secured to opposite ends of a work part, for supplying electrical current to the work part for resistance heating;

a temperature detector that detects a temperature of the work part and generates temperature feedback in order to regulate the electrical current;

an electrical resistance detector that measures an electrical resistance within the work part and generates electrical resistance feedback in order to regulate the electrical current; and a cooling mechanism for engaging at least one of the first and second clamps to reduce temperature increases in the respective clamp that would cause uneven heating in the work part;

wherein the temperature of the work part and the electrical resistance within the work part are measured simultaneously.

8. The apparatus of claim 7, wherein the cooling mechanism comprises a fluid jacket that encases the respective end clamp and supplies cooling fluid to the respective end clamp.

9. The apparatus of claim 7, further comprising a heating control system that receives the feedback from the temperature detector and the electrical resistance detector for regulating the electrical current to the work part in order to control the temperature of the work part.

10. The apparatus of claim 7, wherein the work part comprises a sheet of high-tensile steel having a heat-resistant plating to improve formability.

11. The apparatus of claim 7, wherein the heat-resistant plating on the work part comprises a high fusing point plating material.

12. The apparatus of claim 7, further comprising:

a stamping assembly that stamps the work part simultaneously during resistance heating to form a stamped work part; and a quenching bath that quenches the work part through quick cooling to increase strength.

13. The apparatus of claim 7, wherein the temperature detector comprises a thermal sensor in contact with the work part, and the electrical resistance detector comprises at least one from the group consisting of: a component in series with the work part that measures the current drawn by the work part, and a component configured to each end clamp that measures the voltage drop across the work part.

14. The apparatus of claim 7, wherein the temperature detector comprises a radiative sensor for measuring heat radiation radiating from the work part, and the electrical resistance detector comprises at least one from the group consisting of: a component in series with the work part that measures the current drawn by the work part, and a component configured to each end clamp that measures the voltage drop across the work part.

15. A method of manufacturing comprising:

supplying electrical current to opposite ends of a work part for resistance heating;

measuring a temperature of the work part and generating temperature feedback in order to regulate the electrical current;

measuring an electrical resistance within the work part and generating electrical resistance feedback in order to regulate the electrical current;

simultaneously measuring the temperature of the work part and measuring the electrical resistance within the work part; and reducing localized temperature increases that would cause uneven heating in the work part.

16. The method of claim 15, further comprising:

calculating a temperature based upon the measured electrical resistance within the work part;

comparing the measured temperature with the calculated temperature to determine the precise temperature of the work part;

controlling heating in response to both the temperature feedback and the electrical resistance feedback in order to control the temperature of the work part.

17. The method of claim 15, further comprising:

stamping the work part simultaneously during resistance heating to form a stamped work part; and quenching the work part through quick cooling to increase strength.

* * * * *